United States Patent [19]

Rittmeister et al.

[11] Patent Number: 4,557,072

[45] Date of Patent: Dec. 10, 1985

[54] DOOR ARRANGEMENT FOR THE CONTROL PANEL OF AN APPARATUS

[75] Inventors: Hubert Rittmeister, Salzkotten-Thüle; Karl-Heinz Seroka, Salzkotten, both of Fed. Rep. of Germany

[73] Assignee: Nixdorf Computer A.G., Fed. Rep. of Germany

[21] Appl. No.: 586,795

[22] Filed: Mar. 6, 1984

[30] Foreign Application Priority Data

Mar. 16, 1983 [DE] Fed. Rep. of Germany ..... 3309462

[51] Int. Cl.[4] ..... E05F 15/02

[52] U.S. Cl. ..... 49/27; 109/24.1; 200/61.43

[58] Field of Search ..... 49/26, 27, 28, 35; 200/61, 43; 186/37; 109/10, 24.1

[56] References Cited

U.S. PATENT DOCUMENTS 2,854,116 9/1958 Gray ..... 49/35 X 3,237,933 3/1966 Grosswiller, Jr. et al. ..... 49/28

3,651,986 3/1972 Karecki et al. ..... 49/35 X

*Primary Examiner*—Kenneth Downey

*Attorney, Agent, or Firm*—Krass & Young

[57] ABSTRACT

In a door arrangement (20) for the control panel (14) of an apparatus (12) with a door leaf (26) movable by motor, on the inside of which leaf a sensing arrangement is arranged, the sensing element is formed by a contact strip (40) extending over the total length of the closing edge (30) of the door leaf (26), which strip is movably guided on the inside of the door leaf at an acute angle $\alpha$ to the plane of the door leaf in such a way that in its first position it at least approximately touches or intersects the plane of the outer face (26) of the door leaf. The contact strip (40) is guided in a guide strip (32) which extends over the total length of the closing edge (30) and is fastened to the door leaf (26), which guide strip shows a guide groove (38) for receiving the contact strip (40).

6 Claims, 5 Drawing Figures

DOOR ARRANGEMENT FOR THE CONTROL PANEL OF AN APPARATUS

TECHNICAL FIELD

The invention relates to a door arrangement for the control panel of an apparatus, particularly a money dispenser, including a door leaf which is movable by means of a door drive in its plane between an open position unblocking the control panel and a closed position covering the control panel, in which it lies at least approximately against a stop face by a closing edge with a direction transverse to the direction of motion, and a sensing device arranged on the door leaf and controlling the door drive with a sensing element which is movable between a first position protruding over the closing edge and a second position aligned with the closing edge.

BACKGROUND OF THE INVENTION

The invention quite generally applies to that type of apparatus in which certain parts are to be secured against access by unauthorized persons or against outside influences such as for example weather. In particular, however, the invention concerns the so-called automatic banking machines which as a rule are built into the outer wall of a building and serve particularly for dispensing money outside of the window business hours of a banking or credit institution. Usually the outer door covering the control panel of the automatic money dispenser opens after the insertion of a customer card into an inquiry unit. In order to secure the automatic money dispenser against manipulation by unauthorized persons, the door arrangement must be relatively sturdy and have a suitable powerful door drive which cannot easily be stopped.

With such door arrangements there is the danger that when the door leaf closes, articles such as a ball point pen or even the finger of a user may be pinched between the closing edge of the door leaf and the stop face. It has already been proposed to monitor the closing region of the door arrangement by means of a photoelectric device. However in units arranged outside, such as the automatic banking machines or automatic money dispensers mentioned, there is the danger that the optical components of the photoelectric device will get dirty or the photoelectric device will become lastingly blocked in some other way and thereby interfere with the closing mechanism. Moreover a door arrangement described at the start is already known in which a strip pivotable around an axis parallel to the closing edge is arranged on the inside of the door leaf, which strip hangs out downward over the closing edges when the door leaf is open and is swung when the door leaf is put in place on the stop face. This solution has the disadvantage that objects which protrude into the gap between closing edge and stop face only by a length corresponding to the thickness of the door leaf are not detected by the sensing device.

SUMMARY OF THE INVENTION

The invention is based on the problem of offering a door arrangement of the type mentioned at the start with which the pinching of objects between the door leaf and the stop face is reliably prevented along the whole length of the closing edge, and which therewith is robust and simple in design.

This problem is solved according to the invention by having the sensing element formed by a contact strip extending over the total length of the closing edge, which is guided movably on the inside of the door leaf at an acute angle to the plane of the door leaf in such a way that in its first position it at least approximately touches or intersects the plane of the outer surface of the door leaf.

In the arrangement according to the invention, any object, regardless of how far it protrudes into the closing path of the door leaf, first comes into contact with the contact strip. When the door leaf together with the sensing device is moved further, then the contact strip is first moved until its edge face turned toward the stop face is aligned with the closing edge of the door leaf. Within this movement path of the contact strip a corresponding contact can then be actuated which will stop the door drive. In the open position of the door leaf, therefore, the contact strip is pushed completely in front of the closing edge of the door leaf, so that the sensing device responds even when an object protrudes into the gap between the door leaf and the stop face by only a distance corresponding to the thickness of the door leaf.

It is advantageous to have the contact strip guided in a guide strip extending over the total length of the closing edge and fastened to the door leaf, which guide strip shows a guide groove for receiving the contact strip. Through this guiding of the contact strip on its whole length, any bending or twisting of the contact strip is practically excluded, so that the sensing device is robust and nearly trouble-free. It is advantageous for the contact strip to be under initial stress in its first position in which it extends out over the closing edge of the door leaf. This is also advantageous in door arrangements in which the closing edge of the door leaf is formed by the bottom edge of the latter and in which the contact strip can thus drop down under the force of gravity when the door is opened. The initial stress of the contact strip in its first position overcomes any frictional resistance which might arise due to dirt in the guide of the contact strip.

The door drive is preferably controlled by having at least one limit switch arranged on the guide strip which switch is connected with a control circuit for the door drive and the switch element of which protrudes into the sliding path of the contact strip. Here the guide strip and the contact strip are preferably arranged relative to the door leaf in such a way that the guide strip and the door leaf do not quite touch the stop face in the door leaf's closed position, in order to prevent scratching of the stop face when the door leaf and the guide strip are frequently touched down. For the same reason, the contact strip on its edge face turned towards the stop face shows at least one projection rising slightly over this edge face, where preferably a narrow projection is provided at each end of the contact strip. The contact strip therefore is seated on the stop face by only its narrow projection, so that this face does not become scratched.

Further features and advantages of the invention are seen from the following description which in combination with the annexed drawings will explain the invention on the basis of an embodiment example.

BEST MODE FOR CARRYING OUT THE INVENTION

Figure 1:
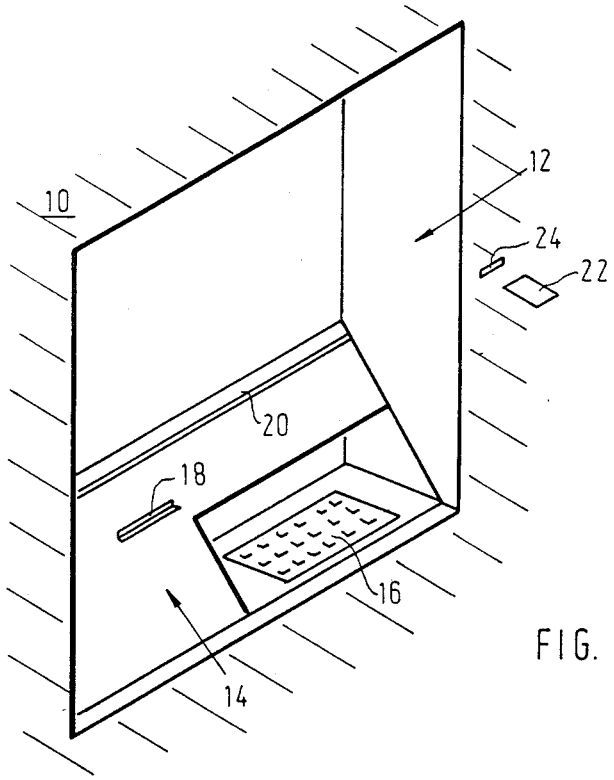
FIG. 1 shows a perspective diagrammatic respresentation of an apparatus according to the invention.

In FIG. 1, 10 designates a wall into which an automatic money dispenser 12 is built in, which is known in itself and will not be described further here. This includes a control panel 14, of which only a keyboard 16 and a money dispensing slot 18 are shown here by way of example. The control panel 14 can be covered by a sliding door arrangement 20 which is represented in its open position in FIG. 1, in which the door leaf is slid into the automatic money dispenser. The door 20 is generally opened by a customer's inserting a customer card 22 through a slot 24 in an inquiry unit. The arrangement described thus far is known in itself.

Figure 3:
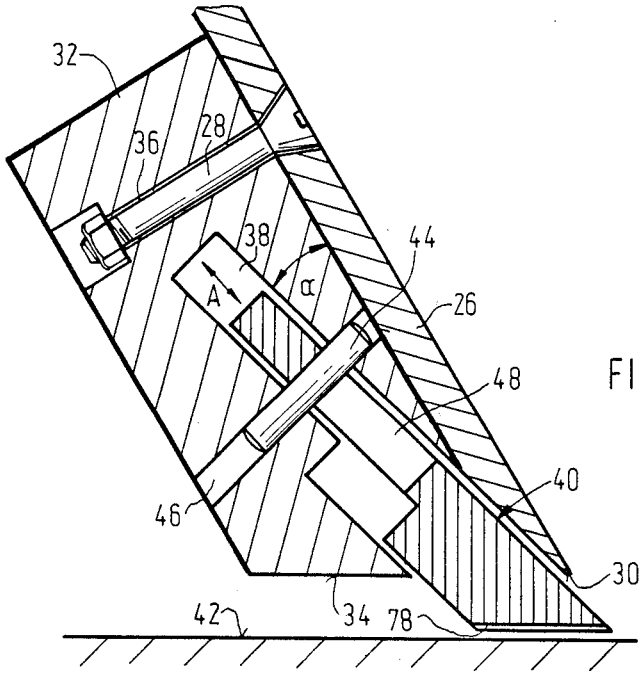
FIG. 3 shows a section along line III—III in FIG. 2.
Figure 4:
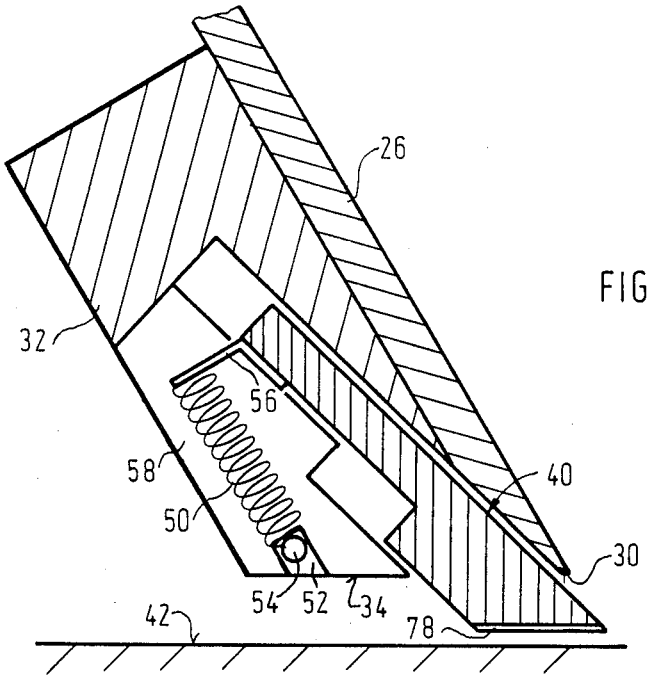
FIG. 4 shows a section along line IV—IV in FIG. 2.
Figure 5:
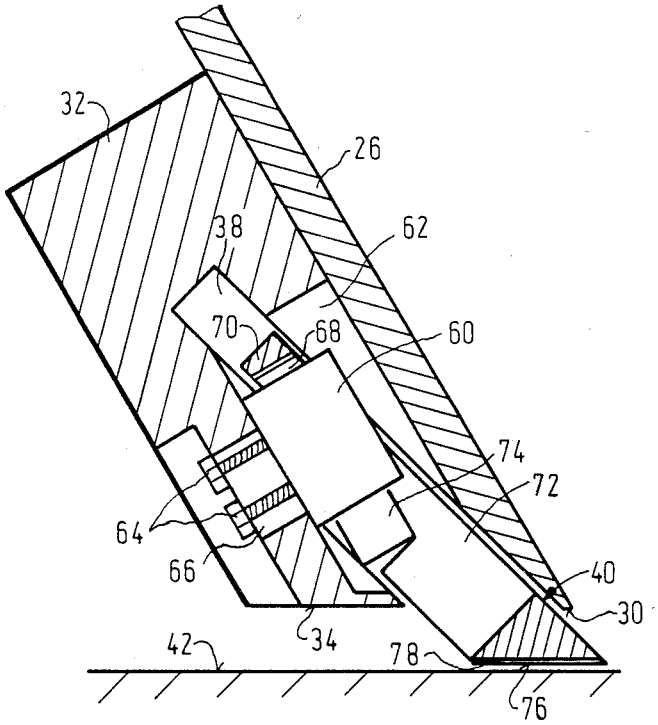
FIG. 5 shows a section along line V—V in FIG. 2, respectively on an enlarged scale.

FIGS. 3 to 5 show the lower region of the door 20, that is the region near the closing edge of the door 20, in a section running perpendicularly to the closing edge. The door 20 according to this includes a door leaf 26, which for example is formed by a steel plate some millimeters thick. A guide strip 32 extending over the whole length of the closing edge 30 is fastened by means of bolts 28 onto the inside of the door leaf 26, the bottom edge face 34 of which strip is aligned with the closing edge 30 of the door leaf 26. The bolts 28 here pass through the guide strip in bored holes 36.

In the guide strip 32 is formed a groove 38 extending over its total length to receive a contact strip 40 likewise extending over the total length of the closing edge 30 of the door leaf 26. The contact strip 40 is movable to and fro in the groove 38 in the direction of the double arrow A. The groove 38 and thus also the plane of motion of the contact strip 40 forms an acute angle $\alpha$ with the plane of the door leaf 26, so that therefore the contact strip 40 is not parallel to the door leaf 26 but is movable at an angle $\alpha$ with respect to the door leaf 26. This has the consequence that with the door 20 opened the contact strip 40 slides under the closing edge 30 and intersects the plane corresponding to the outside of the door leaf 26, as is represented in FIGS. 3 to 5. Thus it is impossible for an object to protrude from the outside into the closing region between the door 20 and a stop face 42 interacting with this, an object which will not first be touched by the contact strip 40. This prevents any kind of object from being pinched between the closing edge 30 of the door leaf 26 and the stop face 42 without being detected by the sensing device.

Figure 2:
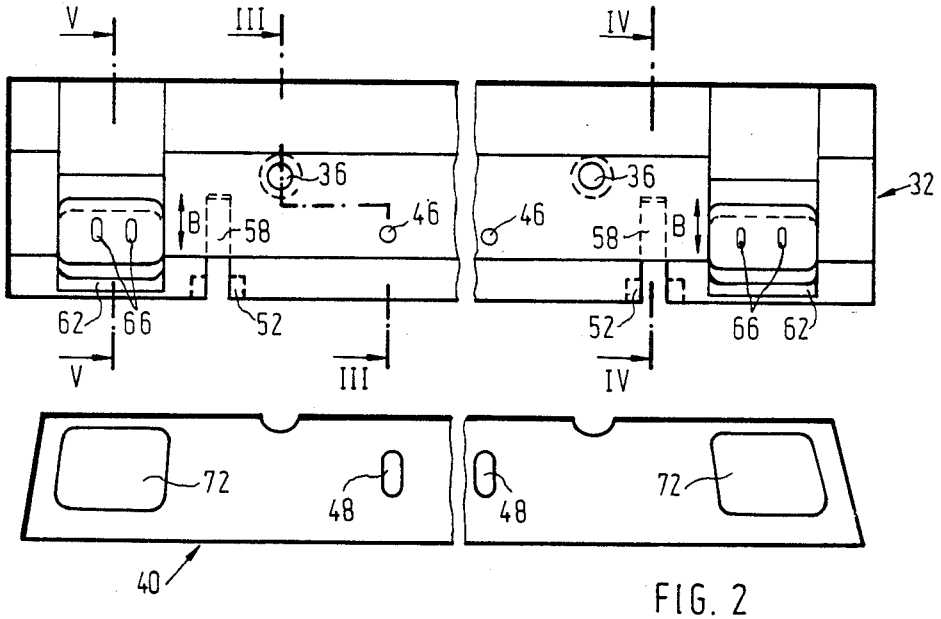
FIG. 2 shows a top plan view of the faces of the guide strip and of the contact strip which are respectively turned toward the door leaf.

According to FIGS. 2 and 3 the contact strip 40 is held in the groove 38 of the guide strip 32 by clindrical pins 44 which are seated in cylindrical bore holes 46 in the guide strip 32 and respectively pass through an oblong hole 48 in the contact strip 40. The position and length of the oblong holes 48 determine the path of motion of the contact strip 40.

According to FIGS. 2 and 4 the contact strip 40 is pushed out by a tension spring 50 into its bottom position, that is into its contact position. The tension spring 50 is suspended on one side on a cylindrical pin 54 inserted in an oblong hole 52 of the guide strip 32 and engages by its other end on a bracket 56 which is connected with the sensing or contact strip 40. The tension spring 50 and the bracket 56 here are arranged in a groove 58 which is built into the guide strip 32.

In FIG. 5 is represented the connection between the contact strip 40 and a control circuit, not represented, for the door drive, likewise not represented, for moving the door leaf 26. For this a microswitch 60 is provided which is arranged in a recess 62 in the guide strip 32 (see also FIG. 2). The bolts 64 holding the microswitch 60 fast on the guide strip 32 grip through an oblong hole 66 formed in the guide strip 32, so that the microswitch can be moved and thereby adjusted in the direction of the double arrow B. At the top end of the microswitch 60 there is a switching device or switching element 68 which is actuated by the upper edge 70 of an aperture 72 formed in the contact strip 40 when, in accordance with the representation of FIG. 5, the contact strip 40 is in its lower position or contact position. At the lower end of the microswitch 60 there is a soldered connection 74 for the connection with the control circuit, now shown of the door drive.

The microswitch 60 is adjusted in such a way that the door drive is stopped when the contact strip 40 has moved all the way in the groove 38 and its face 76 turned to the stop face 42 is aligned with the closing edge 30 of the door leaf 26 and the face 34 of the guide strip 32. In order to prevent the door leaf 26 and the guide strip 32 in this condition from lying against the stop face 42 and scratching this by the frequent opening and closing of the door, two ribs 78 are formed on the outer end of the contact strip 40 at its lower side 76 which ribs rise about 0.4 mm over the face 76 and show a width of about 3 mm. Thereby the whole door arrangement lies on the stop face 42 by only the ribs 76.

We claim:

1. Door arrangement for the control panel of an apparatus, particularly a money dispenser, including a door leaf which is movable by means of a door drive in its plane between an open position unblocking the control panel and a closed position covering the control panel, in which it lies at least approximately against a stop face by a closing edge with a direction transverse to the direction of motion, and a sensing device arranged on the door leaf and controlling the door drive with a sensing element which is movable between a first position protruding over the closing edge and a second position aligned with the closing edge, characterized in that the sensing element is formed by a contact strip (40) extending over the total length of the closing edge (30) which is guided movably on the inside of the door leaf at an acute angle $\alpha$ to the plane of the door leaf in such a way that in its first position it at least approximately touches or intersects the plane of the outer surface (26) of the door leaf.

2. Door arrangement as claimed in claim 1, characterized in that the contact strip (40) is guided in a guide strip (32) extending over the total length of the closing edge (30) and fastened to the door leaf (26), which guide strip shows a guide groove (38) for receiving the contact strip (40).

3. Door arrangement as claimed in claim 1 or 2, characterized in that contact strip (40) is under initial stress in its first position.

4. Door arrangement as claimed in claim 1, characterized in that at least one limit switch (60) is arranged on the guide strip (32) which switch is connected to a control circuit for the door drive and the switch element (68) of which protrudes into the sliding path of the contact strip (40).

5. Door arrangement as claimed in claim 2, characterized in that the guide strip (32) and the contact strip (40) are arranged relative to the door leaf (26) in such a way that the guide strip (32) and the door leaf (26) do not touch the stop face (42) in the door leaf's closed position.

6. Door arrangement as claimed in claim 1, characterized in that the contact strip (40) on its edge face (76) turned toward the stop face (42) shows at least one projection (78) rising slightly over this edge face.

* * * * *